US005099616A

United States Patent [19]

Hampl et al.

[11] Patent Number: 5,099,616

[45] Date of Patent: Mar. 31, 1992

[54] APPARATUS AND METHOD FOR REDUCING WOOD DUST EMISSIONS FROM LARGE DIAMETER DISC SANDERS WHILE CLEANING A SANDING DISC THEREOF

[75] Inventors: Vladimir Hampl, Pleasant Plain; Ova E. Johnston, Franklin, both of Ohio

[73] Assignee: The United States of America as represented by the Department of Health and Human Services, Washington, D.C.

[21] Appl. No.: 574,972

[22] Filed: Aug. 30, 1990

[51] Int. Cl.[5] ..... B24B 55/06

[52] U.S. Cl. ..... 51/273; 51/268; 51/262 R

[58] Field of Search ..... 31/273, 268, 266, 262 R, 31/262 A

[56] References Cited

U.S. PATENT DOCUMENTS

| | | | |
|---|---|---|---|
| 1,791,917 | 2/1931 | Winsor . | |
| 2,086,516 | 5/1935 | Curtin . | |
| 2,683,958 | 12/1952 | Schneible et al. . | |
| 2,763,972 | 3/1953 | White . | |
| 3,476,662 | 12/1966 | Inoue . | |
| 3,646,712 | 3/1972 | Quintana . | |
| 4,050,194 | 9/1977 | Rice . | |
| 4,228,618 | 10/1980 | Jensen . | |
| 4,525,955 | 7/1985 | Cothrell et al. | 51/273 |
| 4,754,702 | 7/1988 | Müller | 51/273 |
| 4,765,016 | 8/1988 | Iwata . | |
| 4,799,336 | 1/1989 | Yang | 51/273 |
| 4,811,527 | 3/1989 | Ruopsa | 51/273 |
| 4,822,219 | 4/1989 | Wood et al. . | |
| 4,825,736 | 5/1989 | Catanese . | |
| 4,905,420 | 3/1990 | Flachenecker et al. . | |
| 4,986,703 | 1/1991 | Hampl et al. | 51/273 |

*Primary Examiner*—Bruce M. Kisliuk
*Assistant Examiner*—Lawrence Cruz
*Attorney, Agent, or Firm*—Lowe, Price, LeBlanc & Becker

[57] ABSTRACT

For improved removal of dust generated in sanding with a rotating disk sander, while simutaneously maintaining a sanding surface thereof free of clogging by dust particles, there is provided a plurality of compressed gas nozzles distributed lengthwise along an elongated common compressed gas supply manifold. The nozzles preferable are disposed to deliver high velocity jets of a compressed gas into a rotating boundary layer at the rotating sanding disk surface to thereby interact with the boundary layer and to simultaneously forcibly dislodge any dust particles tending to adhere to the air sanding disk surface. Suction is provided around a portion of the sanding disk to remove the dust particles that are entrained in the boundary layer and any dust particles dislodged from the sanding disk surface. In one aspect of this invention, the apparatus thereof may be added to a conventional disk sander apparatus to improve dust collection therefrom.

20 Claims, 2 Drawing Sheets

APPARATUS AND METHOD FOR REDUCING WOOD DUST EMISSIONS FROM LARGE DIAMETER DISC SANDERS WHILE CLEANING A SANDING DISC THEREOF

TECHNICAL FIELD

This invention relates to apparatus and a method for reducing wood dust emissions generated during use of a large diameter disc sander and, more particularly, for apparatus and a method employing a plurality of pressurized air jets interacting with a rotating air boundary layer at the active sanding surface of a large diameter disc sander to facilitate efficient and non-polluting use thereof.

BACKGROUND ART

The forming and shaping of a wood element is often best carried out by pressing of the wood element against a rotating disk having a sanding surface. In one convenient form of such a device, the large sanding disk normally rotates in a vertical plane and a table for supporting the wood element is located about or slightly above a horizontal diameter of the sanding disk. The supporting table surface may be made adjustably pivotable about a horizontal axis. A user of the device typically faces the sanding disk and presses the wood element toward the moving sanding surface of the disk, often at a portion of the disk that would have a tendency to hold the wood element down on the table in the course of sanding portions of the wood element. A small gap is provided between the rotating surface of the disk and an immediately adjacent edge of the table surface.

As will be readily appreciated, even if suction is provided by external means to suck away the fine wood dust generated in such an operation, an air boundary layer generated adjacent the rotating surface of the sanding disk will create an air flow pattern toward the center of the disk surface and then radially outwardly thereof. Furthermore, portions of the wood sanded away by grit provided at the sanding surface of the disk may have a tendency to at least temporarily adhere to portions of the grit and this may tend to reduce the efficacy of the sanding operation. Such adhered wood particles may eventually become released from the sanding disk surface and, due to the air boundary layer flow, may also fly off radially from the disk surface at considerable speeds. As a consequence of such mechanisms, even with suction hoods provided above and below the table and to the sides of the sanding disk, as is common in much of the known prior art, there tends to be an unacceptable degree of air pollution in the workplace due to fine wood particles not promptly removed upon generation during use of the device.

As noted, there are numerous structures employed for providing a zone of suction close to a sanding surface in a mechanical sander. Some of these devices also employ compressed air jets to dislodge wood particles that tend to otherwise adhere to grit on a moving sanding surface.

One example of such a device is taught in U.S. Pat. No. 1,791,917, to Winsor, in which an endless sanding belt passed over two large generally cylindrical pulleys or rollers is applied to an upper surface of a wood board to sand the same and compressed air is provided through a plurality of holes in a pipe disposed close to the surface of the belt as it is about to pass over one of the cylindrical pulleys, with a suction hood being provided around the sanding belt as it passes over that pulley.

In another known example, per U.S. Pat. No. 4,525,955, to Cothrell et al., also relating to an endless sanding belt passed over a cylindrical guide pulley, the entire belt is enclosed within a shroud and intermittent blasts of compressed gaseous fluid, e.g., compressed air, are directed onto the surface of the belt as it traverses its orbital path. Specifically, the compressed gas is directed onto the surface of the belt within the shroud and at a point wherein the belt is wrapped around the surface of the roller or pulley which opens the grid pattern of the belt fabric slightly. As a consequence, wood particles that otherwise would tend to remain attached to the belt are dislodged and sucked away.

U.S. Pat. No. 3,646,712, to Quintana, teaches a dust-removing attachment device for a rotary disk power grinder or sander, wherein a continuous current of air is maintained over and around the grinding or sanding surface by flow of a pressurized gas through apertures located around a portion of an arc surrounding the sanding disk. The flow of pressurized air withdraws dust particles and the like and a mixture of compressed air and dust particles is sucked away at a location on a side of the disk sander opposite the pressurized air inlet apertures.

Numerous other generally similar devices are known in the relevant art. None, however, appear to be particularly satisfactory for use with large disk sanders in which a user presents a wood element to a substantially vertical surface of a large rotating sanding disk, wherein the user is not exposed to find particles released during the operation and the sanding disk surface is continuously cleaned of adhering wood particles.

DISCLOSURE OF THE INVENTION

Accordingly, it is a principal object of the present invention to provide apparatus facilitating capture of fine wood dust particles generated at a sanding surface of a large disk sander while simultaneously dislodging from grit on the sanding surface wood particles that otherwise tend to adhere thereto.

Another object of the present invention is to employ a combination of suction and a directed flow of compressed air to interact with an air boundary layer formed during operation of a rotating disk sander to efficiently remove fine dust particles generated during a sanding operation, while simultaneously dislodging wood particles that tend to adhere to grit of the sanding surface.

It is yet another object of the present invention to provide an apparatus combinable with existing large rotating disk sanders to improve suppression of particulate air pollution due to fine wood dust generated thereby, while simultaneously and continuously cleaning a sanding surface of the disk.

A related object of the present invention is to provide a method for combining suction and a directed flow of compressed air to interact with an air boundary layer generated at the surface of a large rotating sanding disk, to suppress particulate air pollution while maintaining the sanding disk surface in clean and unclogged condition.

A related further object of the present invention is to provide a method for improving control of particulate air pollution related to the generation of fine wood particles in operating large rotating disk sanders while simultaneously providing continuous cleaning of the effective sanding surface of the rotating sanding disk.

These and other related objects of the present invention will be understood from the following description of the present invention, with reference to various figures of the drawing provided herewith, and are realized by providing an apparatus for improved removal of dust generated during use of a disk sander, comprising:

a plurality of compressed gas nozzles disposed to deliver a flow of a compressed gas at a predetermined velocity into a rotating air boundary layer at a rotating sanding disk surface; and means for providing a suction to remove said compressed gas flow and any dust particles entrained therein.

In another, related, aspect of the invention there is provided a method of reducing dust pollution from a disk sander comprising the steps of:

directing a flow of a compressed gas through a plurality of nozzles disposed radially of a rotating disk of said sander at a predetermined angle with respect to a sanding surface of said rotating disk into a rotating air boundary layer thereof to thereby interrupt entailment of dust particles in said air boundary layer and to simultaneously dislodge any dust particles tending to adhere to said sanding surface.

DETAILED DESCRIPTION OF THE PREFERRED EMBODIMENTS

Figure 1:
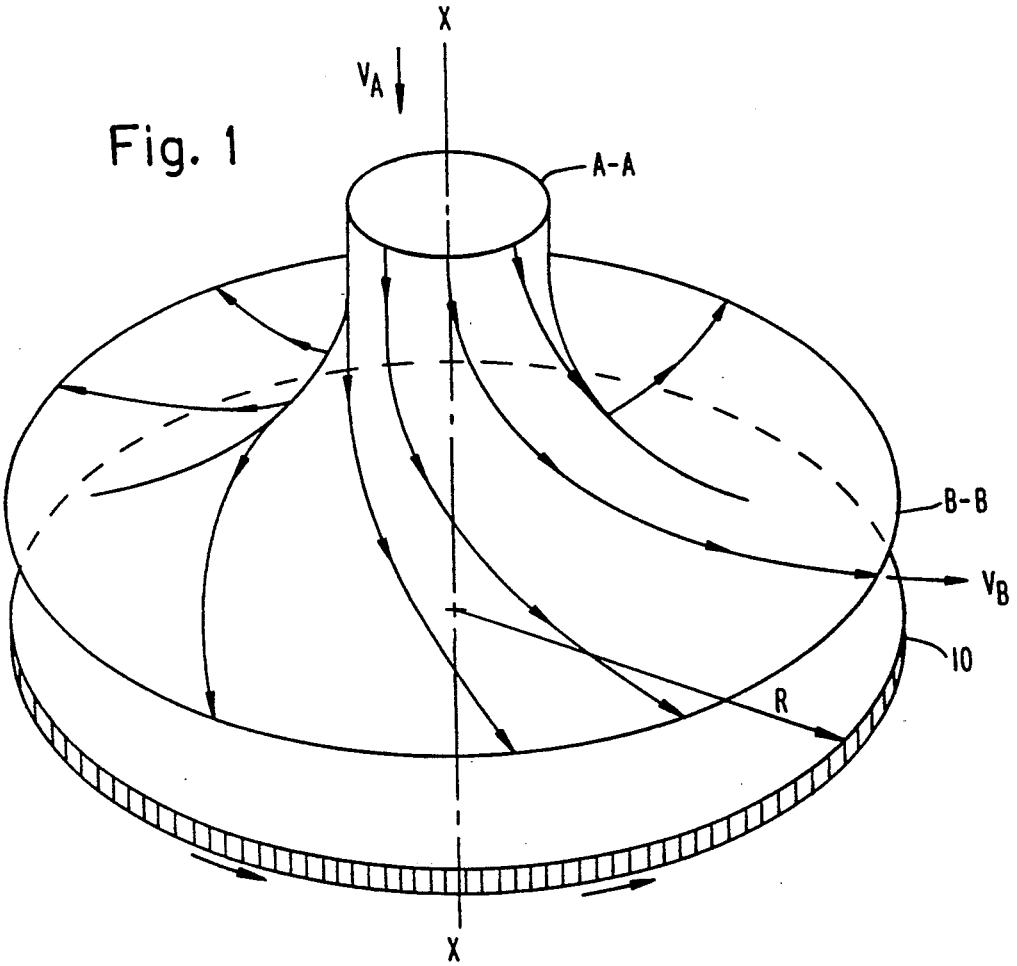
FIG. 1 is a schematic diagram illustrating the direction of air flow in a boundary layer generated during rotation of a large flat disk such as a sanding disk in a large disk sander apparatus.

As schematically illustrated in FIG. 1, when a flat circular disk 10, e.g., a sanding disk in a disk sander, is rotated in ambient air about an axis X—X, friction between air and the flat rotating surface of the disk causes the air immediately adjacent to the disk surface to be forced into circular motion around axis X—X. This layer of rotating air immediately adjacent the rotating surface of the disk naturally experiences centrifugal acceleration and is, in essence, flung literally outward from the rotating disk surface. As a consequence, ambient air close to the axis of rotation is pulled in in the direction of the axis of rotation toward the rotating disk and it too is eventually forced into rotation by friction and is flung outwardly of the disk by centrifugal acceleration due to the resultant rotation. Under these circumstances, as would be visually noticeable if a smoke stream or a fine powder were released in the ambient air, a swirling boundary layer is generated adjacent the rotating disk surface and the flow of ambient air as a velocity envelope having the shape indicated by the spiralling arrows in FIG. 1. For convenience of reference, note that rotating disk 10 has a radius "R" with respect to the axis of rotation X—X, ambient air initially moving along the axis of rotation has at some section A—A a velocity $V_A$, and the air flow immediately adjacent the rotating disk at radius "R" at a section identified for convenience as B—B has an air flow velocity "$V_B$".

As previously noted, FIG. 1 is merely a schematic illustration and persons skilled in fluid mechanics will immediately appreciate that the interjection of a table to support a wood element being sanded by a sanding disk 10, as in a conventional disk sander assembly, will interfere with such an idealized air flow pattern. Nevertheless, a typical large sanding disk having a diameter of up to 48 inches and rotated at a few hundred RPM will generate a flow pattern in which ambient air will tend to be drawn towards the center of rotation and, by friction with the rotating sanding surface, will tend to be flung radially outwardly of the disk. If a piece of wood is pressed against a grit-impregnated sanding surface of the disk, fine wood particles torn off the wood element by the grit will tend to be entrained within the local velocity envelope which is approximated in rather idealized form in the illustration of FIG. 1.

The principal factor of interest in the present context is that the described air flow tends to carry with it fine wood particles sanded away from the wood element contacting the grit-implemented sanding surface of the rotating disk. Also, as previously noted, portions of the wood dust may have a tendency to adhere to the grit particles at the disk sanding surface. Naturally, the more resin or stickiness that a particular wood contains, the correspondingly greater tendency of resin-loaded wood particles sanded therefrom to continue to adhere to the grit on the disk sanding surface. If this tendency of the wood particles to adhere to the sanding disk surface is not controlled, sooner or later there will be a tendency for the grinding surface to become clogged and correspondingly ineffective in sanding more wood.

It is, therefore, an important objective of the present invention, first, to interact and deliberately interfere with the local boundary layer to facilitate efficient suction thereafter of the dust-laden air by known means, and second, to ensure against clogging of the sanding disk surface due to adherence of fine wood dust particles to the grid elements on the sanding disk surface.

Figure 2:
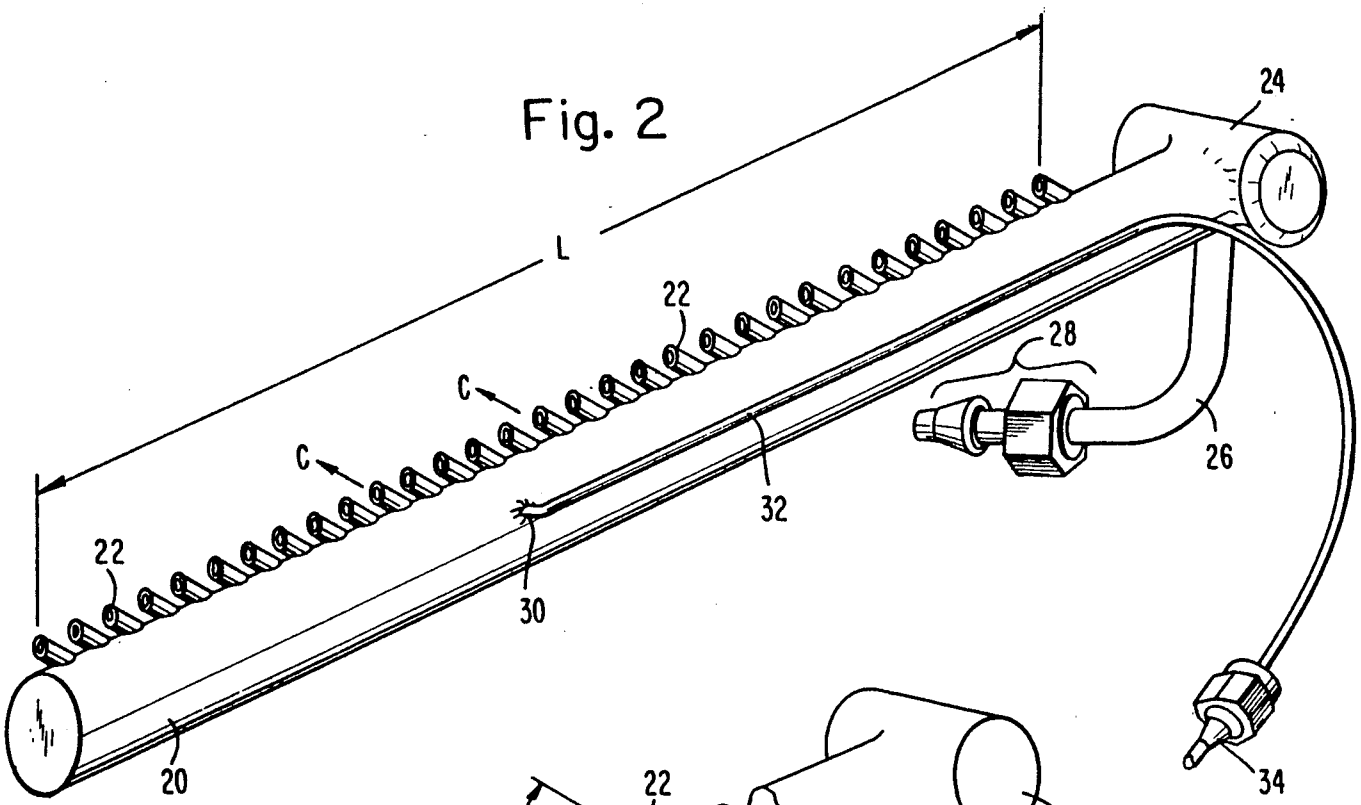
FIG. 2 is a perspective view of a preferred embodiment of the apparatus of the present invention.
Figure 3:
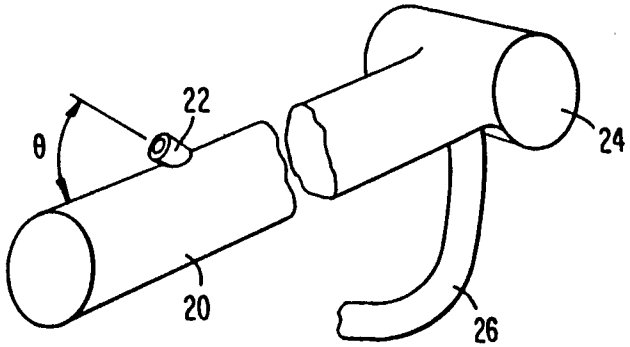
FIG. 3 is a partial perspective schematic view to illustrate and explain details of the geometry of an exemplary compressed air discharge nozzle according to the preferred embodiment of FIG. 2.

The principal components of the present invention, according to a preferred embodiment thereof, are best understood with reference to FIGS. 2 and 3. In FIG. 2, there is shown an elongate tubular manifold 20 having a closed distal end and a manifold junction box 24 provided with a plurality of jet nozzles 22 in a longitudinal array at the outside surface of manifold 20. The plurality of nozzles 22 is disposed between the closed end of manifold 20 and junction box 24 communicating therewith. Junction box 24 also communicates with a compressed gas supply tube 26 provided with a conventional fitting assembly 28 for connection to a known source of a compressed gas, e.g., a tank of compressed air supplied by a conventional air compressor (neither is shown for simplicity).

In order to exercise appropriate control over the compressed gas flow provided by nozzles 22 at a suitable location 30 of manifold 20 there is provided a pressure-sensing tube 32 having a conventional connection fitting 34. Any conventional pressure measuring device may be thus connected through fitting 34 to pressure-sensing tube 32, to thereby determine a pressure of a compressed gas within manifold 20, specifically at a location 30 therein.

As will be appreciated, the number and physical dimensions of the plurality of compressed gas nozzles 22 is a matter of design choice which a person of ordinary skill in the mechanical arts can fairly be expected to exercise with consideration given to the size of the sanding disk with which the present invention is to be used.

What is important, however, is that compressed gas delivered through manifold 20 and ejected through the plurality of compressed gas nozzles 22 is directed at a predetermined angle $\theta$ as best understood with reference to FIG. 3. FIG. 3 illustrates a single exemplary compressed gas nozzle 22 attached to manifold 20 and inclined with respect thereto so as to deliver a directed flow of compressed gas at an angle $\theta$ with respect to a longitudinal line drawn through the junction of compressed gas nozzle 22 and the outermost surface of manifold 20.

Experiments with a prototype device according to the present invention indicate that for an exemplary manifold having a diameter approximately 0.625 inches, connected to a supply of compressed air in the range 20–35 pounds per square inch, with individual compressed gas nozzles being formed of short lengths of tubing with an internal diameter approximately 0.035 inches, most effective performance is obtained when $\theta$ is less than 45°, and preferably 30° with respect to an axial direction of manifold 20 when manifold 20 is disposed parallel to the sanding surface of the sanding disk 10. In other words, for optimum results in disturbing the local boundary layer of air, which otherwise tends to entrain dust particles and discharge them in undesirable ways, and to simultaneously dislodge adhered wood particles from the grit of the sanding disk surface, compressed air is best delivered at about 30° to the sanding disk surface. Air directed from the individual compressed gas nozzles 22 with a radially outward component vis-a-vis the sanding disk was found to produce highly beneficial results.

In the exemplary prototype just discussed, for simplicity the individual compressed gas nozzles, each having an internal diameter of approximately 0.035 inches, were formed of metal tubing having an axial length of approximately 0.375 inches. Other forms may also be used to obvious advantage.

The experimental studies described in the preceding paragraphs revealed that a device according to FIGS. 2 and 3, for the selected dimensions, was particularly effective when the distance between the distal ends of compressed gas nozzles 22 and the rotating sanding disk surface was not larger than 0.400 inches.

Figure 4:
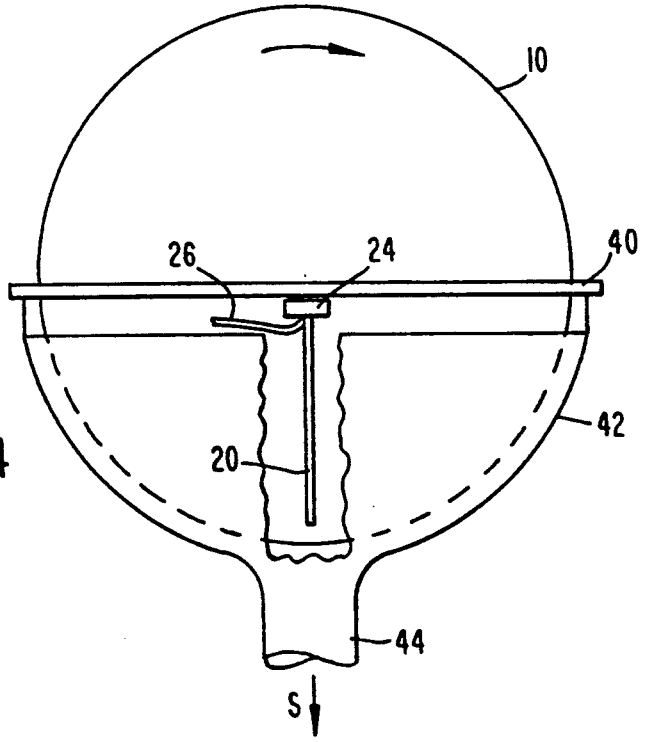
FIG. 4 is a partially sectioned schematic vertical elevation view illustrating the disposition of the principal elements of a large rotating disk sander according to a preferred embodiment of the present invention.

Referring now to FIG. 4, it will be seen that with a rotating sanding disk 10 disposed for convenience in a vertical plane, i.e., so as to rotate about a horizontal axis through conventional drive means (not shown for simplicity) a table having an upper surface 40 may be disposed at or slightly above the center of rotation of sanding disk 10. A user of the device places a wood element on upper surface 40 of the table and pushes it in a controlled manner toward the rotating sanding disk surface to obtain the desired sanding action thereby. When the user is handling relatively small or light wood elements, in accordance with conventional safe practice, the wood element is pressed against the rotating sanding disk on the right hand side in the structure illustrated schematically in FIG. 4, so that frictional force between the wood element and the sanding disk surface tends to hold the wood element firmly on upper surface 40 of the supporting table.

A conventional suction hood 42 may be provided immediately below and to the sides supporting surface 40 and be connected by ducting 44 to any known source for generating a suction. Consequently, there will be established a tendency for dust particles to be sucked away in the direction of arrow "S" in FIG. 4.

When such a conventional disk sander arrangement is to be utilized with the present invention, as best understood with reference to FIG. 4, manifold 20 may conveniently be disposed at a predetermined small distance away from the sanding surface of disk 10 beneath the element supporting surface 40. To facilitate suction of the wood dust particles, it is preferable that manifold 20 be oriented vertically downward so that the combined effects of the radially downward velocity component of the released compressed gas directed by compressed gas nozzles 22, local centrifugal acceleration of the boundary layer, and the acceleration due to gravity will cooperate to facilitate movement of fine wood dust particles in the direction of arrow "S" in which air is sucked by suction applied to duct 44.

It should be understood that the delivery of a flow of a compressed gas through a plurality of inclined compressed gas nozzles, as indicated by arrows "C" in FIG. 2, has a tendency to disturb the boundary layer immediately adjacent the sanding disk surface in such a manner that entrained wood dust particles are prevented from continuing to rotate with the boundary layer but, instead, are flung radially outward from the exposed part of the sanding disk. This disturbance of the air boundary layer immediately adjacent the, sanding disk within the suction shroud is found to be extremely effective in removing dust particles that are not physically attached to the grit of the sanding disk.

There is, however, a further advantage in that the provision of a sufficiently fast flow of air through the plurality of compressed gas nozzles 22 also forcibly dislodges fine wood particles that would otherwise tend to adhere to and clog up the spaces between grit particles impregnated into the sanding disk surface. Manifold 20, for reasons already discussed, is preferably oriented in a downward radial direction vis-a-vis the rotating disk, hence the direction of rotation of the sanding disk, i.e., clockwise or counterclockwise, becomes irrelevant, and the dislodged dust is drawn by suction through duct 44 in a most effective manner. Note that the dislodgment of dust from the sanding disk grit is at an optimum under the combined effects of momentum transfer from the impinging air to lodged dust, centrifugal acceleration and gravitational acceleration, all acting downwards.

It should be appreciated that once the boundary layer adjacent the disk is disturbed as the disk passes the plurality of compressed gas nozzles 22, even as the rotating disk surface tends to generate a replacement boundary layer, the application of suction below the wood element supporting surface 40 tends to draw ambient air past the disk downward into suction shroud 42. It is believed that this contributes to the effectiveness of the resultant wood dust collection.

As will be appreciated, the structure illustrated in FIGS. 2 and 3 is simple and relatively inexpensive to manufacture and dispose within conventional sanding disk apparatus. Accordingly, the pollution-abating benefits of the present invention may be readily realized by retrofitting almost any existing large vertical disk sander apparatus at small cost and without the need for expensive ancillary equipment since most woodworking workshops usually have means for providing suction to remove particulates from air around the workers.

As previously noted, conventional sanding disk apparatus of known type may have the facility for adjusting the relative angular relationship between the rotating sanding disk surface and the wood element supporting surface 40. Persons of ordinary skill in the mechanical arts can be expected to provide suitable support for manifold 20, as generally illustrated in FIG. 4, so that the plurality of compressed gas nozzles 22 are maintained at an optimum separation from the rotating sanding disk surface. Such details of structure, employing only conventional devices and elements, involve at most minor adaptations of existing elements and structures and will, therefore, not be further described herein.

It is possible that when particularly hard wood, e.g., maple or ash, is to be sanded, the wood dust generated therefrom may be different from that generated in sanding resinous wood such as pine. Persons of ordinary skill in the art, monitoring the pressure of the compressed gas delivered to manifold 20 can be expected to utilize known means for controlling the pressure so as to provide a higher pressure when dealing with resinous wood, the dust from which may be more likely to clog the grid impregnated sanding surface of disk 10. Such details of operational control are best left to the individual operator to adjust as appropriate under given circumstances.

It should be understood that only the preferred embodiments are described and illustrated in detail herein, but that persons of ordinary skill in the art may wish to make obvious modifications to the described structures within the spirit of the present invention. The forms of the present invention as described above are therefore to be taken as merely exemplary and not as limiting, the invention itself being defined solely by the claims appended hereto.

We claim:

1. Apparatus for improved removal of dust generated during use of a disk sander, comprising:

a plurality of compressed gas nozzles disposed to direct a flow of a compressed gas at a predetermined velocity to interact with a rotating air boundary layer at a rotating sanding disk surface, wherein said compressed gas flows from said gas nozzles with a velocity component directed radially outwardly with respect to said rotating sanding disk surface; and means for providing suction to remove said interacted compressed gas and air boundary layer flows and any dust particles entrained therein.

2. Apparatus according to claim 1, wherein:

said plurality of nozzles receives said compressed gas from a common elongate manifold and said nozzles are disposed along an outside longitudinal surface of said manifold radially of a rotation axis of said rotating sanding disk.

3. Apparatus according to claim 1, wherein:

said compressed gas from each of said plurality of compressed gas nozzles flows at a predetermined angle not greater than 45° with respect to said rotating sanding disk surface.

4. Apparatus according to claim 2, wherein:

said compressed gas from each of said plurality of compressed gas nozzles flows at a predetermined angle not greater than 45° with respect to said rotating sanding disk surface.

5. Apparatus according to claim 1, wherein:

said nozzles are evenly separated and are disposed to extend from an axis of rotation of said rotating sanding disk over the entire radius thereof.

6. Apparatus according to claim 1, wherein:

said nozzles are evenly separated and are disposed to extend from an axis of rotation of said rotating sanding disk over the entire radius thereof.

7. Apparatus according to claim 2, wherein:

said manifold is disposed vertically downward below an axis of rotation of the sanding disk; and a predetermined spacing is provided between said plurality of nozzles and said sanding disk.

8. Apparatus according to claim 1, further comprising:

means for sensing a pressure of a flow of said compressed gas provided to said plurality of nozzles.

9. Apparatus according to claim 1, wherein:

means for sensing a pressure of a flow of said compressed gas provided to said plurality of nozzles, said pressure sensing means comprising a tube communicating with said manifold.

10. An improved rotating disk sander including a rotating sanding disk, a support surface for supporting an element to be sanded by the sanding disk, and means for applying suction around the adjacent to a lower portion of the rotating sanding disk to remove dust generated in sanding, the improvement comprising:

means for providing a directed flow of a compressed gas along a radius of said lower portion of said sanding disk to interact with a local rotating air boundary layer on said rotating disk, to thereby disolodge sanded dust particles tending to attach to a sanding surface of said sanding disk and simultaneously facilitating suction removal of any dust particles located with said rotating air boundary layer, wherein said compressed gas flows from said gas nozzles with a velocity component directed radially outwardly with respect to said rotating sanding disk surface.

11. The improved disk sander according to claim 10, wherein said directed flow means comprises a plurality of compressed gas nozzles disposed to direct a flow of a compressed gas at a predetermined velocity to interact with said rotating air boundary layer, and means for providing suction to remove said interacted compressed and air boundary layer gas flows and any dust particles entrained therein.

12. The improved disk sander according to claim 11, wherein:

said plurality of nozzles receives said compressed gas from a common elongate manifold and said nozzles are disposed along an outside longitudinal surface of said manifold radially of a rotation axis of said rotating sanding disk.

13. The improved disk sander according to claim 11, wherein:

said compressed gas from each of said plurality of compressed gas nozzles flows at a predetermined angle not greater than 45° with respect to said rotating sanding disk surface.

14. The improved disk sander according to claim 11, wherein:

said nozzles are evenly separated and are disposed to extend from an axis of rotation of said rotating sanding disk over the entire radius thereof.

15. The improved disk sander according to claim 11, wherein:

means for sensing a pressure of a flow of said compressed gas provided to said plurality of nozzles.

16. The improved disk sander according to claim 11, wherein:

said manifold is disposed vertically downward below an axis of rotation of the sanding disk; and a predetermined spacing is provided between said plurality of nozzles and said sanding disk.

17. A method of reducing dust pollution from a rotating disk sander comprising the steps of:

providing a flow of a compressed gas through a plurality of nozzles disposed radially of a rotating disk of said sander at a predetermined angle less than 90° with respect to a sanding surface of said rotating disk into a rotating air boundary layer thereof to thereby interrupt entrainment of dust particles in said air boundary layer and to simultaneously dislodge any dust particles tending to adhere to said sanding surface; and directing said compressed gas flow from said nozzles with a velocity component directed radially outwardly with respect to said rotating sanding disk surface.

18. A method according to claim 17, comprising the further step of:

applying suction to a portion of said sanding disk to remove said dust particles from said interrupted air boundary layer and any dust particles dislodged from said sanding surface.

19. A method according to claim 17, comprising the further steps of:

sensing a pressure of a flow of said compressed gas provided to said plurality of nozzles; and controlling a flow of said compressed gas in accordance with said sensed pressure.

20. A method according to claim 17, wherein:

said compressed gas flow from said plurality of nozzles is provided at a predetermined distance from said rotating sanding disk surface at a predetermined angle not greater than 45° with respect thereto with said radially outward velocity component directed downwardly with respect to a rotation axis of said sanding disk.

* * * * *